US008284050B1

(12) United States Patent
Montgomery et al.

(10) Patent No.: US 8,284,050 B1
(45) Date of Patent: Oct. 9, 2012

(54) DRINKING VESSEL WITH INTEGRAL LOCATING DEVICE

(76) Inventors: Daril Montgomery, Ivel, KY (US); Carly Montgomery, Ivel, KY (US)

( * ) Notice: Subject to any disclaimer, the term of this patent is extended or adjusted under 35 U.S.C. 154(b) by 480 days.

(21) Appl. No.: 12/555,544

(22) Filed: Sep. 8, 2009

Related U.S. Application Data

(60) Provisional application No. 61/190,998, filed on Sep. 5, 2008.

(51) Int. Cl.
*G08B 1/08* (2006.01)

(52) U.S. Cl. ..... 340/539.32; 340/539.1; 340/573.1; 340/825.49; 340/825.69

(58) Field of Classification Search ..... 340/539.32, 340/539.1, 539.11, 573.1, 825.49, 825.69, 340/825.72; 219/432, 435, 436, 438
See application file for complete search history.

(56) References Cited

U.S. PATENT DOCUMENTS

| | | | | |
|---|---|---|---|---|
| 3,931,494 | A | 1/1976 | Fisher et al. | |
| D336,825 | S | 6/1993 | Ivey | |
| 5,243,684 | A * | 9/1993 | Edwards | 392/444 |
| 5,294,915 | A | 3/1994 | Owen | |
| 5,598,143 | A | 1/1997 | Wentz | |
| D380,269 | S | 6/1997 | Mendes | |
| 5,662,685 | A | 9/1997 | Uhler | |
| D419,240 | S | 1/2000 | Leick | |
| 6,066,161 | A | 5/2000 | Parella | |
| 6,353,391 | B1 * | 3/2002 | Shearer | 340/573.1 |
| 6,398,019 | B1 | 6/2002 | Cheng | |
| D470,942 | S | 2/2003 | Pecora et al. | |
| 6,570,504 | B2 | 5/2003 | Rabanne et al. | |
| D475,890 | S | 6/2003 | Mazonkey | |
| 6,809,644 | B1 | 10/2004 | Titus et al. | |
| 7,417,417 | B2 * | 8/2008 | Williams et al. | 324/71.1 |
| 7,642,912 | B2 * | 1/2010 | Sholem | 340/539.32 |

* cited by examiner

*Primary Examiner* — Hung T. Nguyen
(74) *Attorney, Agent, or Firm* — Montgomery Patent & Design, LLC; Robet C. Montgomery; Joseph Yaksich

(57) ABSTRACT

A drinking vessel with an attached wireless locator system comprises a detachable drinking vessel base housing having an internal receiver and a speaker powered by a rechargeable battery when the drinking vessel is placed on a contact surface portion of a charging base. The drinking vessel base and internal electronics are separate and removable which allows the drinking vessel to be washed and/or sterilized. A button on the recharging base activates a transmitter which signals the receiver on the drinking vessel to activate an audible alarm on the drinking vessel base. An illuminated lamp to further aid in finding the drinking vessel when misplaced is also provided. The charging base and transmitter receive electrical power from a standard wall outlet.

19 Claims, 7 Drawing Sheets

DRINKING VESSEL WITH INTEGRAL LOCATING DEVICE

RELATED APPLICATIONS

The present invention was first described in U.S. Provisional Patent Application No. 61/190,998 filed on Sep. 5, 2008, the entire disclosures of which are incorporated herein by reference.

FIELD OF THE INVENTION

The present invention relates generally to a cup for children, and in particular, to a child's cup with an integral locating device that may be easily located when misplaced.

BACKGROUND OF THE INVENTION

One of the most frustrating items to lose is an infant "sippy" cup. The act of locating such a small item is frustrating in and of itself. The corresponding fuss of the infant while looking for such an item multiplies this frustration greatly. Also, should the infant find such a missing cup and consume the contents, the risk of sickness and illness is not insignificant. Accordingly, there exists a need for a means by which child "sippy" cups can be easily found when misplaced.

Various attempts have been made to provide a method to locate such an item. Examples of these attempts can be seen by reference to several U.S. patents. U.S. Pat. No. 5,598,143, issued in the name of Wentz, describes a device for operating and remotely locating a plurality of television related devices and beepers. The Wentz device includes a separate base assembly with emitters for activating beeping noises within the plurality of associated beepers. U.S. Pat. No. 6,809,644, issued in the name of Titus et al., describes a child's pacifier with integral locating system. The Titus device includes an integral receiver to active light emitting members within the object.

Additionally, ornamental designs for a remotely locatable child cup exist, particularly U.S. Pat. No. D 475,890. However, none of these designs are similar to the present invention.

While these devices fulfill their respective, particular objectives, each of these references suffer from one or more of the aforementioned disadvantages. Many existing locator devices are not properly adapted for use with a child "sippy" cup. Also, many such devices do not provide for recharging capabilities. Furthermore, many such devices are not suitable for detachment to allow for washing of the item. Accordingly, there exists a need for a child "sippy" cup that can be located by remote means without the disadvantages as described above. The development of the present invention substantially departs from the conventional solutions and in doing so fulfills this need.

SUMMARY OF THE INVENTION

In view of the foregoing disadvantages inherent in the prior art, it has been observed that there is need for a drinking vessel locating system includes a drinking vessel, a drinking vessel locator assembly affixed to a base portion of the drinking vessel, wherein such a drink vessel locator assembly includes a receiver assembly.

The present invention further includes a transmitter/charger base provided with a transmitter assembly transmitting a radio signal to the receiver assembly, and a rechargeable battery which is charged when the drinking vessel is placed on the transmitter/charger base. In this manner; an audible sound is activated when the receiver assembly is activated for a predetermined time period.

In one embodiment, the drinking vessel locator assembly may include a male first threaded region, and a female second threaded region located along a bottom perimeter edge of the drinking vessel and being removably engaged to the male first threaded region.

In one embodiment, the drinking vessel locator assembly may include a locator body including a cup-shaped enclosure provided with a speaker and an illuminating member disposed through a wall portion thereof respectively. Such a drinking vessel locator assembly may further include a circular first receiver connector, a first insulator, and a second receiver connector arranged in a circumscribed circular manner along a convex bottom surface of the drinking vessel locator assembly. In this manner, the first and second receiver connectors may be electrically isolated from each other by the first insulator.

In one embodiment, the transmitter/charger base may include a first base connector and a second base connector contacting the first receiver connector and second receiver connector respectively. Such first and second receiver connectors and the corresponding first and second base connectors include matching cup-shaped profiles nested within each other during battery charging procedures. Notably, the circular shape of the first and second base connectors and the first and second receiver connectors provides a recharging current flow to the battery regardless of a rotational position of the drinking vessel when nested within the transmitter/charger base.

In one embodiment, the transmitter/charger base includes a transmitter housing having a generally hemispherical shape with a flat anti-skid bottom surface to thereby provide a stable base on which to charge the drinking vessel locator assembly. A transmitter assembly may be integrally molded to an inner surface of the transmitter/charger base wherein the transmitter assembly includes a transmitter and a second microprocessor electrically coupled thereto.

In one embodiment, the transmitter/charger base may further include a first base connector, a second insulator, and a second base connector contacting the first receiver connector and second receiver connectors. Such first and second base connectors are arranged in a circumscribed circular manner along a concave top surface of the transmitter/charger base so that the first and second base connectors provide a matching physical profile and thereby establish an efficient electrical connection with the first and second receiver connectors.

In one embodiment, the first and second base connectors provide a gravity-aided contact to charge the rechargeable battery.

In one embodiment, the drinking vessel locator assembly may include a receiver, a first microprocessor electrically coupled thereto, a battery electrically coupled to the receiver, a sound generator contained in the locator body and connected to the first microprocessor, and a speaker in communication with the sound generator.

The present invention may further include a method of utilizing a drinking vessel locating system. Such a method preferably includes the following steps: providing a drinking vessel; providing a drinking vessel locator assembly affixed to a base portion of the drinking vessel wherein the drinking vessel includes a receiver assembly; providing a transmitter/charger base including a transmitter assembly that transmits a radio signal to the receiver assembly; providing and charging a rechargeable battery by placing the drinking vessel on the transmitter/charger base; and activating an audible sound when the receiver assembly is activated for a predetermined time period.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
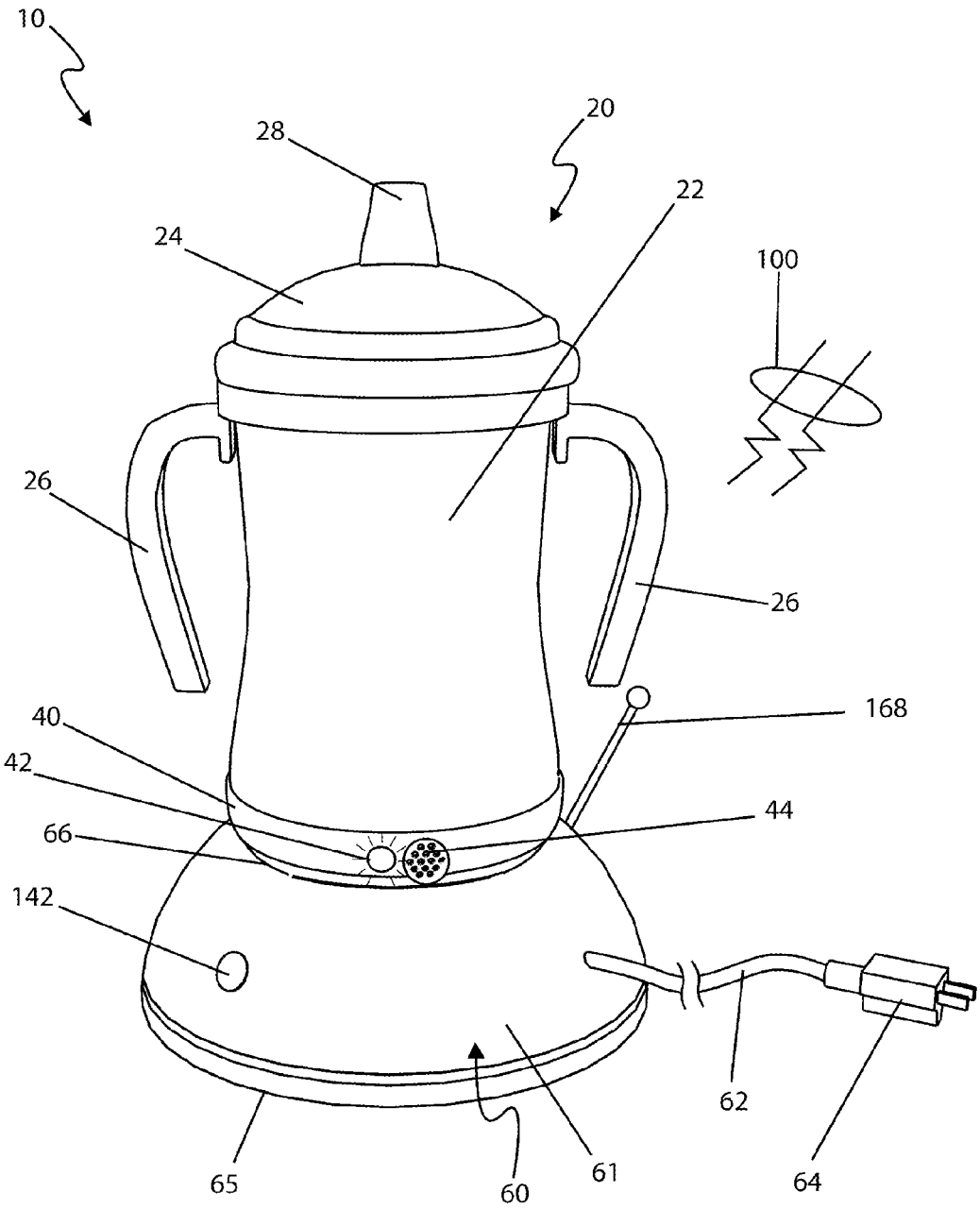
FIG. 1 is a perspective view of a drinking vessel with integral locator 10, according to a preferred embodiment of the present invention.

| | |
|---|---|
| 10 | drinking vessel with integral locator |
| 20 | drinking vessel |
| 22 | drinking vessel body |
| 24 | lid |
| 26 | handle |
| 28 | spout |
| 30 | first threaded region |
| 40 | drinking vessel locator assembly |
| 41 | locator body |
| 42 | illuminating member |
| 44 | speaker |
| 46 | first receiver connector |
| 48 | first insulator |
| 49 | second threaded region |
| 50 | second receiver connector |
| 60 | transmitter/charger base |
| 61 | transmitter housing |
| 62 | power cord |
| 64 | plug |
| 65 | anti-skid surface |
| 66 | first base connector |
| 68 | second insulator |
| 70 | second base connector |
| 100 | radio signal |
| 140 | receiver assembly |
| 141 | receiver |
| 142 | first microprocessor |
| 144 | rechargeable battery |
| 146 | sound generator |
| 160 | transmitter assembly |
| 161 | transmitter |

-continued

| | |
|---|---|
| 162 | control button |
| 164 | second microprocessor |
| 168 | antenna |

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a drinking vessel with integral locator (herein described as the "device") 10, which allows for easy location of a drinking vessel 20 in a home when misplaced. The device 10 comprises a drinking vessel portion 20 having a threadingly attached drinking vessel locator assembly 40 affixed thereto a base portion of the drinking vessel 20 which further comprises a radio frequency receiver assembly 140. The drinking vessel locator assembly 40 is powered by an internal rechargeable battery 144 which is charged when the drinking vessel 20 is placed on a transmitter/charger base 60 during periods of non-use. The transmitter/charger base 60 comprises an external control button 162 which activates a transmitter assembly 160 which in turn transmits a radio signal 100 thereto the receiver assembly 140. When the receiver assembly 140 is thus activated, an audible sound is emitted therefrom a speaker 44 as well as a visual indicator therefrom an illuminating member 42. The speaker 44 an illuminating member 42 are envisioned to remain active for a period of time of approximately fifteen (15) to twenty (20) seconds to allow a user to locate the drinking vessel 20. In such a manner, a parent or care provider can easily find the misplaced drinking vessel 20.

Referring now to FIG. 1, a perspective view of the device 10, according to the preferred embodiment of the present invention, is disclosed. The device 10 comprises a drinking vessel locator assembly 40. The drinking vessel locator assembly 40 is threadingly attached thereto the drinking vessel 20 and powered by an internal rechargeable battery 144 which is charged when the drinking vessel 20 is placed on a circular first base connector portion 66 of the transmitter/charging base 60 (see FIGS. 3*b* and 4).

The drinking vessel 20 is illustrated here depicting a common child's "sippy" cup providing expected conventional features such as, but not limited to: a hollow cylindrical body 22, a snap-on lid 24, a pair of opposing handles 26, and a spout 28; however, other drinking vessels providing similar function but having various designs may also utilize the advantages of the present invention 10 and as such should not be interpreted as a limiting factor of the device 10.

The transmitter/charger base 60 receives electrical power through a power cord 62 having a standard integral electrical plug 64. The electrical plug 64 is to be inserted thereinto a standard wall power socket in an expected manner, thereby providing standard household voltage. When the electrical plug 64 is plugged into a wall power socket, electrical current is transferred through the power cord 62 into the transmitter/charger base 60, conducted thereinto the drinking vessel locator assembly 40 via the first base connector 66, thereby charging the rechargeable battery portion 144 therewithin the drinking vessel locator assembly 40. Furthermore, the transmitter/charger base 60 has an antenna 168 for transmitting a radio signal 100 to the drinking vessel locator assembly 40. When a user wants to locate the drinking vessel 20 they simply push the control button 162 to activate the transmitter assembly portion 160 of the device 10.

Figure 2:
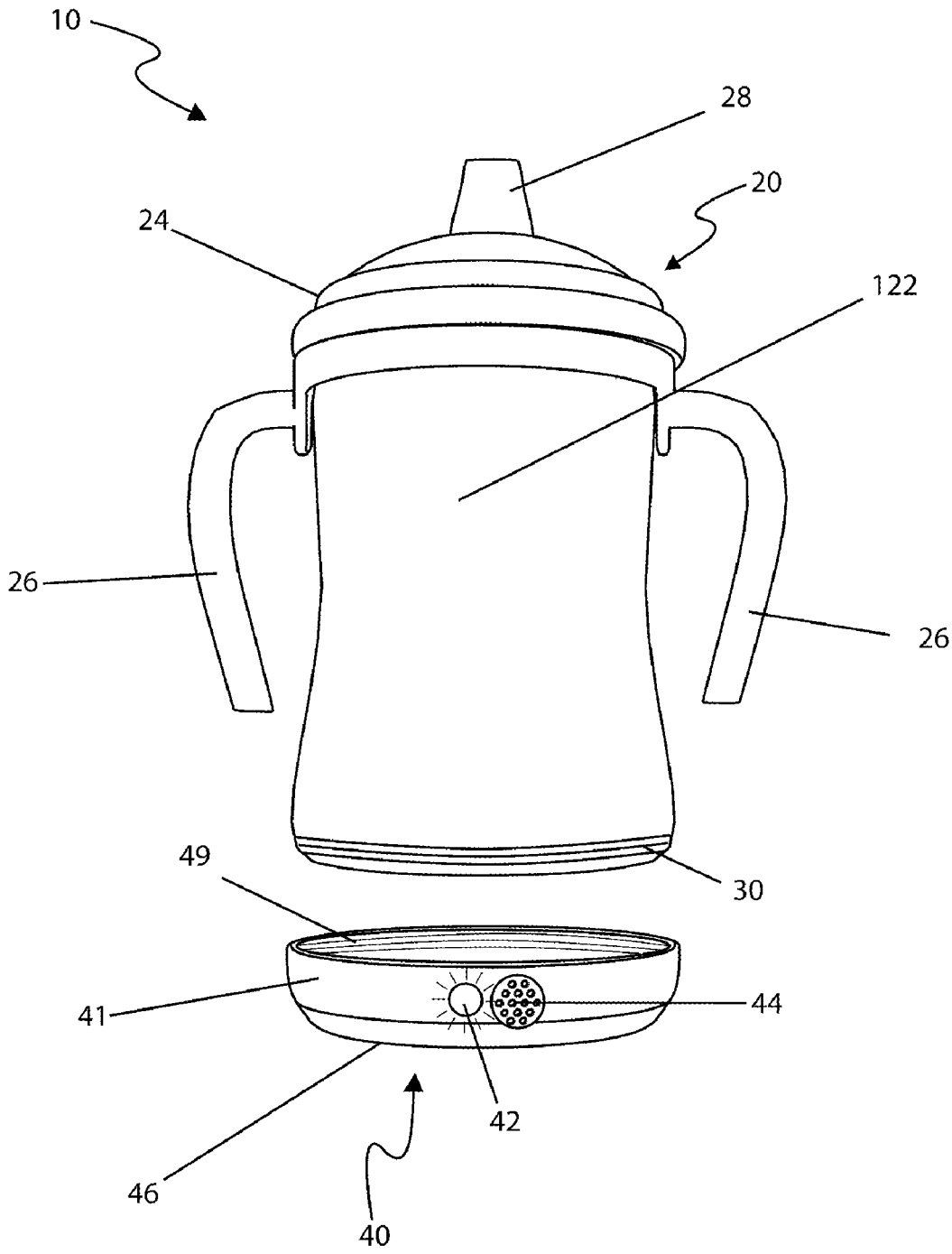
FIG. 2 is a side perspective view of a of a drinking vessel 20 with a removable drinking vessel locator assembly 40 detached, according to a preferred embodiment of the present invention.

Referring now to FIG. 2, a side perspective view of the drinking vessel 20 with the removable drinking vessel locator assembly 40 detached, according to the preferred embodiment of the present invention, is disclosed. The drinking vessel locator assembly 40 provides a threaded attachment means thereto the drinking vessel 20 via a male first threaded region 30 which is sized so as to threadingly engage a corresponding female second threaded region 49 located along a bottom perimeter edge of the drinking vessel 20. The threaded attachment of the drinking vessel locator assembly 40 thereto the drinking vessel 20 allows the drinking vessel 20 to be threadingly detached and washed, run through the dishwasher, and/or be sterilized without the drinking vessel locator assembly 40 attached, thereby avoiding possible damage to said drinking vessel locator assembly 40. Additionally, the drinking vessel 20 may be washed while the rechargeable battery 144 portion of the drinking vessel locator assembly 40 is being charged thereupon the transmitter/charger base 60.

Figure 3A:
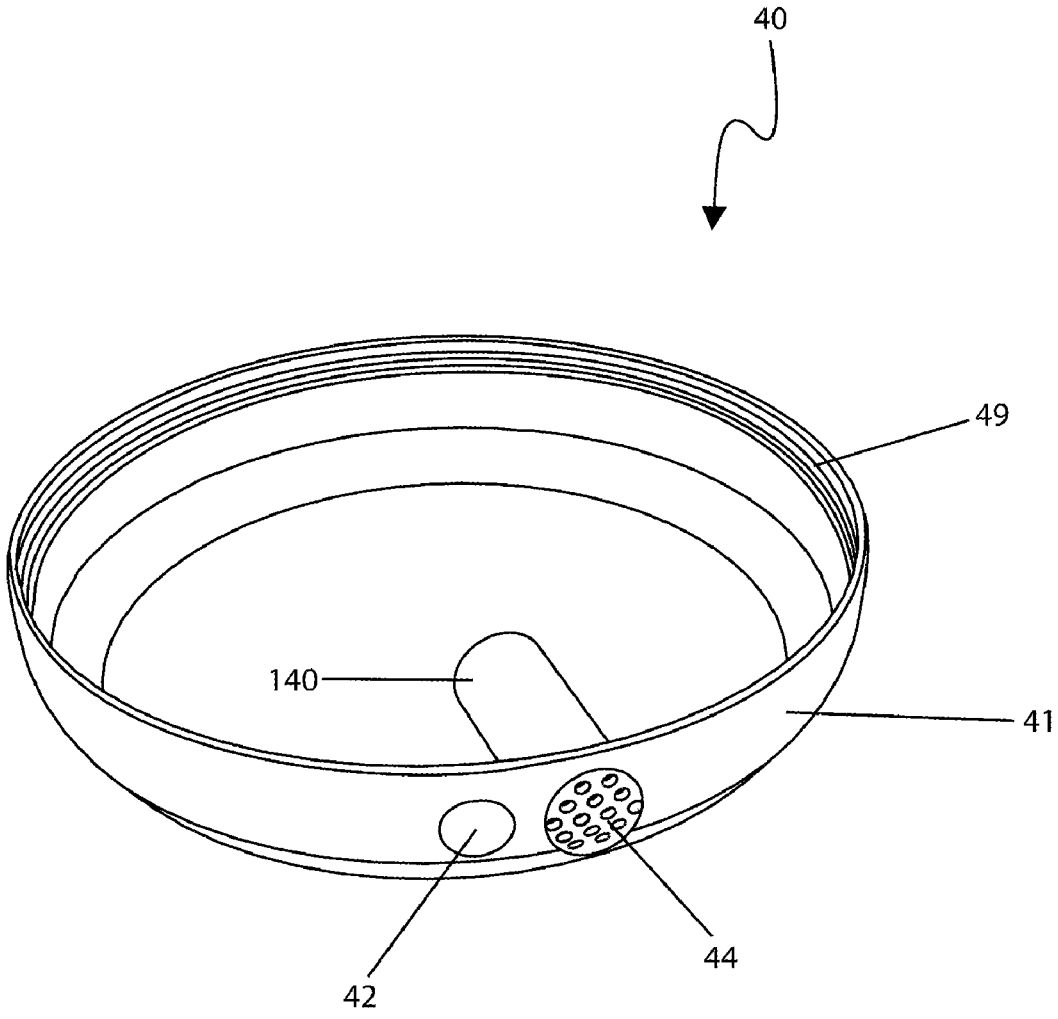
FIG. 3*a* is a side perspective view of a drinking vessel locator assembly 40, according to a preferred embodiment of the present invention.
Figure 3B:
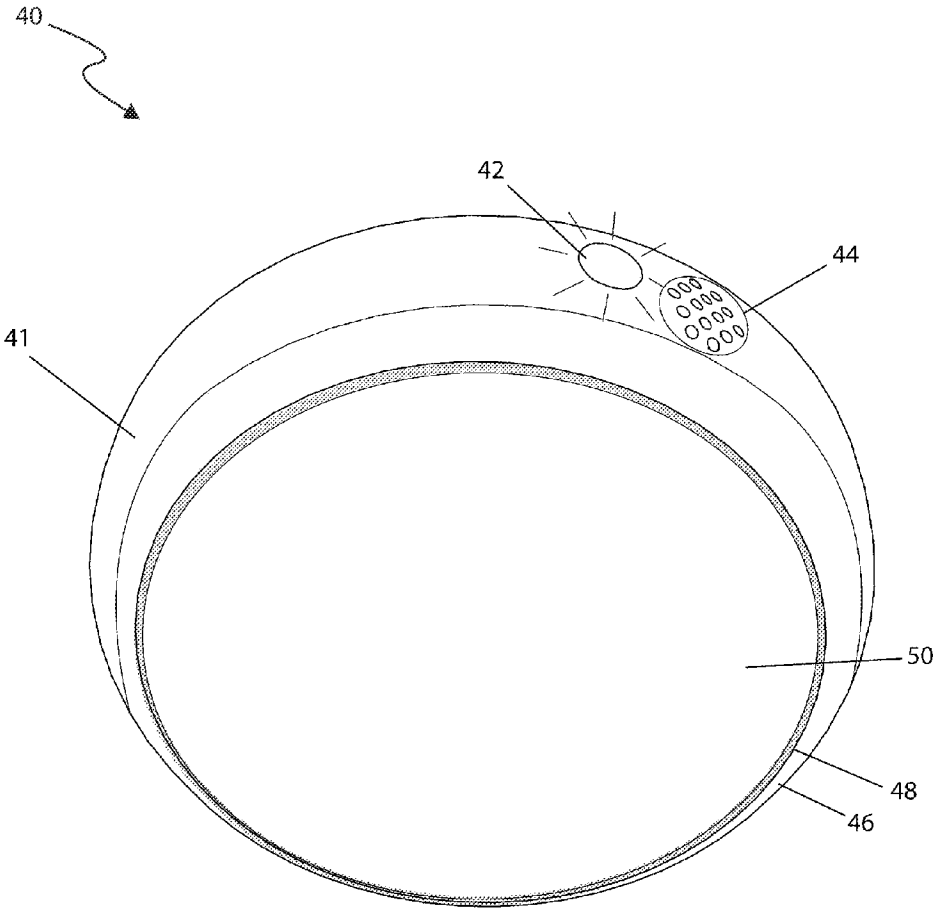
FIG. 3*b* is a bottom perspective view of a drinking vessel locator assembly 40, according to a preferred embodiment of the present invention.

Referring now to FIGS. 3*a* and 3*b*, side and bottom perspective views of the drinking vessel locator assembly 40, according to the preferred embodiment of the present invention, are disclosed. The drinking vessel locator assembly 40 comprises a locator body 41 and an internal radio frequency (RF) receiver assembly 140. The locator body 41 comprises a molded plastic enclosure having a cupped-shaped form further comprising a speaker 44 and an illuminating member 42 being disposed therethrough a wall portion thereof. The locator body 41 also provides a molded attachment means thereto a receiver assembly 140 being located along an inside wall portion of said locator body 41. The receiver assembly 140 further comprises internal portions including a receiver 141, a first microprocessor 142, a rechargeable battery 144, and a sound generator 146 (see FIG. 5). When the receiver assembly 140 is activated, the speaker 44 emits an audible sound in the form of beeping noises or sounds, and the illuminating member 42 provides illumination, thereby allowing a user to hear said noises and see said illumination to more easily locate the drinking vessel 20 when it is misplaced.

A charging current from the transmitter/charger base 60 is conducted thereto the locator body 41 via a circular first receiver connector 46, a first insulator 48, and a second receiver connector 50 being arranged therein a circumscribed circular manner along convex bottom surface of said drinking vessel locator assembly 40. Said connectors 46, 50 provide a gravity-aided contact method to charge the internal rechargeable battery 144. The first 46 and second 50 receiver connectors are electrically isolated therefrom each other by the first insulator 48, thereby separating the ground and power portions of the charging circuit. When the first receiver connector 46 and second receiver connectors 50 make contact therewith corresponding first base connector 66 and second base connectors 70 (see FIG. 4), a flow of charging current is supplied thereto the rechargeable battery 144 therewithin the receiver assembly 140. The first 46 and second 50 receiver connectors and corresponding first 66 and second 70 base connectors comprise matching cup-shaped profiles so as to provide stable nesting therewithin each other during battery 144 charging. The circular shape of the connectors 46, 50, 66, 70 provides a recharging current flow thereto the battery 144 regardless of the rotational position of the drinking vessel 20 when nested therewithin the transmitter/charger base 60.

Figure 4:
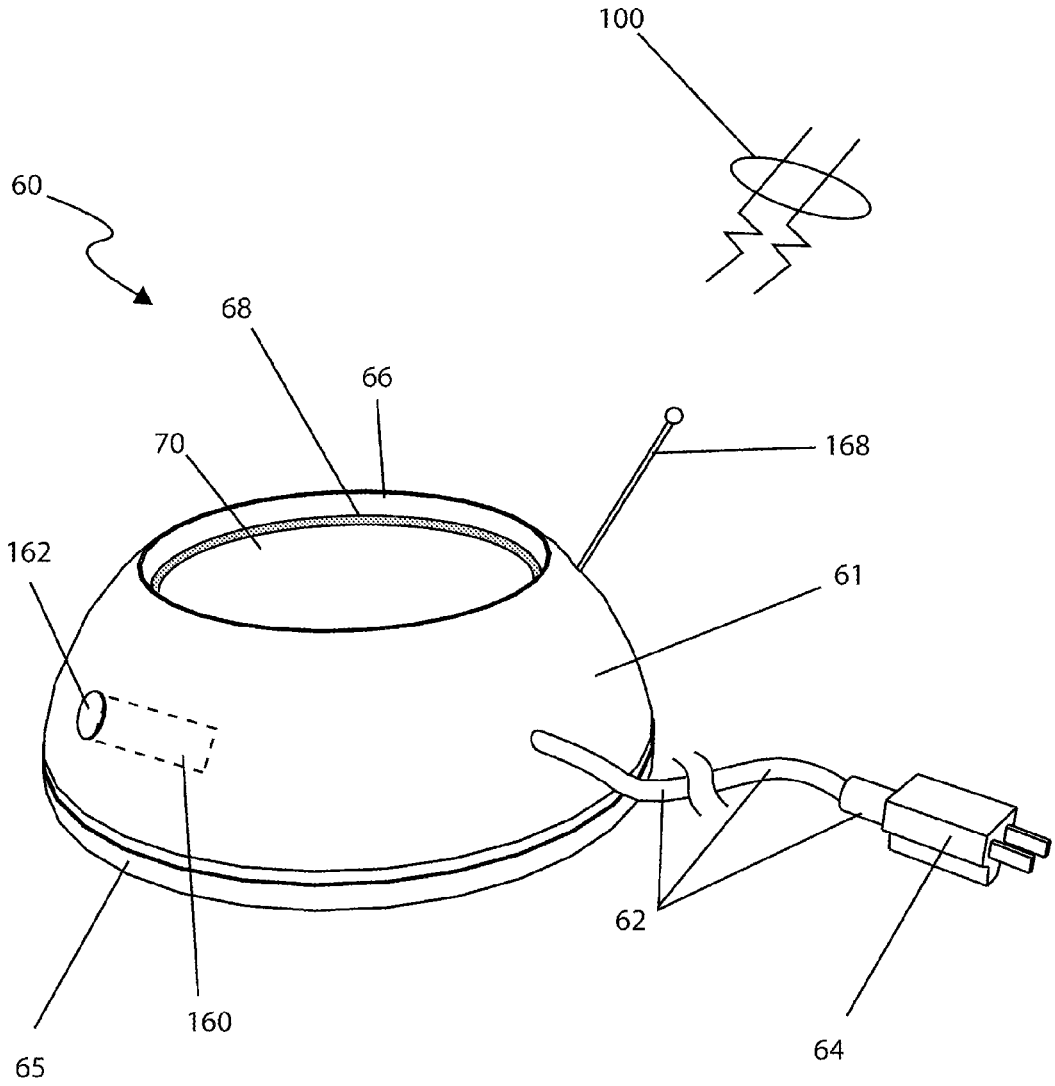
FIG. 4 is a perspective view of a transmitter/charger base 60, according to a preferred embodiment of the present invention.

Referring now to FIG. 4, a perspective view of the transmitter/charger base 60, according to the preferred embodiment of the present invention, is disclosed. The transmitter/charger base 60 comprises a transmitter housing 61 and a transmitter assembly 160. The transmitter housing 61 comprises a molded plastic enclosure having a generally hemispherical shape with a flat bottom with a rubber or plastic anti-skid surface 65, thereby providing a stable base on which to charge the drinking vessel locator assembly 40 (see FIG. 1). The transmitter housing 61 provides an attachment means thereto a transmitter assembly 160 being integrally molded thereto an inner surface of the transmitter/charger base 60. Said transmitter assembly 160 is powered by an affixed power cord 62 and electrical plug 64 being plugged into a standard wall socket in an expected manner. The transmitter assembly 160 also includes an externally accessed control button 162 being conventionally mounted thereto an external surface of the transmitter housing 61. The transmitter housing 61 further provides a mounting means thereto an antenna 168 along an exterior surface providing a transmitting means thereto a radio signal 100 being conveyed in a conventional manner thereto the drinking vessel locator assembly 40. The antenna 168 is depicted here being an externally-mounted type antenna; however, it is understood that said antenna 168 may also be provided as an internal antenna unit being mounted therewithin the transmitter housing 61 providing an equivalent transmission of said radio signal 100 and as such should not be interpreted as a limiting factor of the device 10. Activation of the transmitter assembly 160 and radio signal 100 is accomplished by pressing the control button 162, thereby providing transmission of said radio signal 100 thereto the antenna portion 168 of the receiver assembly portion 140. The transmitter assembly 160 further comprises additional internal functional portions including a transmitter 161 and a second microprocessor 164 (see FIG. 6).

The transmitter/charger base 60 also comprises a first base connector 66, a second insulator 68, and a second base connector 70, which provide electrical communication of respective ground and power circuit members when in contact therewith the first receiver connector 46 and second receiver connectors 50. Said electrical communication of the connectors 46, 50, 66, 70 provides a charging means thereto the rechargeable battery portion 164 of the drinking vessel locator assembly 40. Said first 66 and second 70 base connectors are arranged in a circumscribed circular manner along a concave top surface of said transmitter/charger base 60. Said first 66 and second 70 base connectors provide a matching physical profile so as to establish an efficient electrical connection therewith the first 46 and second 50 receiver connectors. Said base connectors 66, 70 provide a gravity-aided contact method to charge the rechargeable battery 144 as previously described. The first 66 and second 70 base connectors are electrically isolated therefrom each other via the second insulator 68, thereby separating the ground and power portions of the charging circuit.

Figure 5:
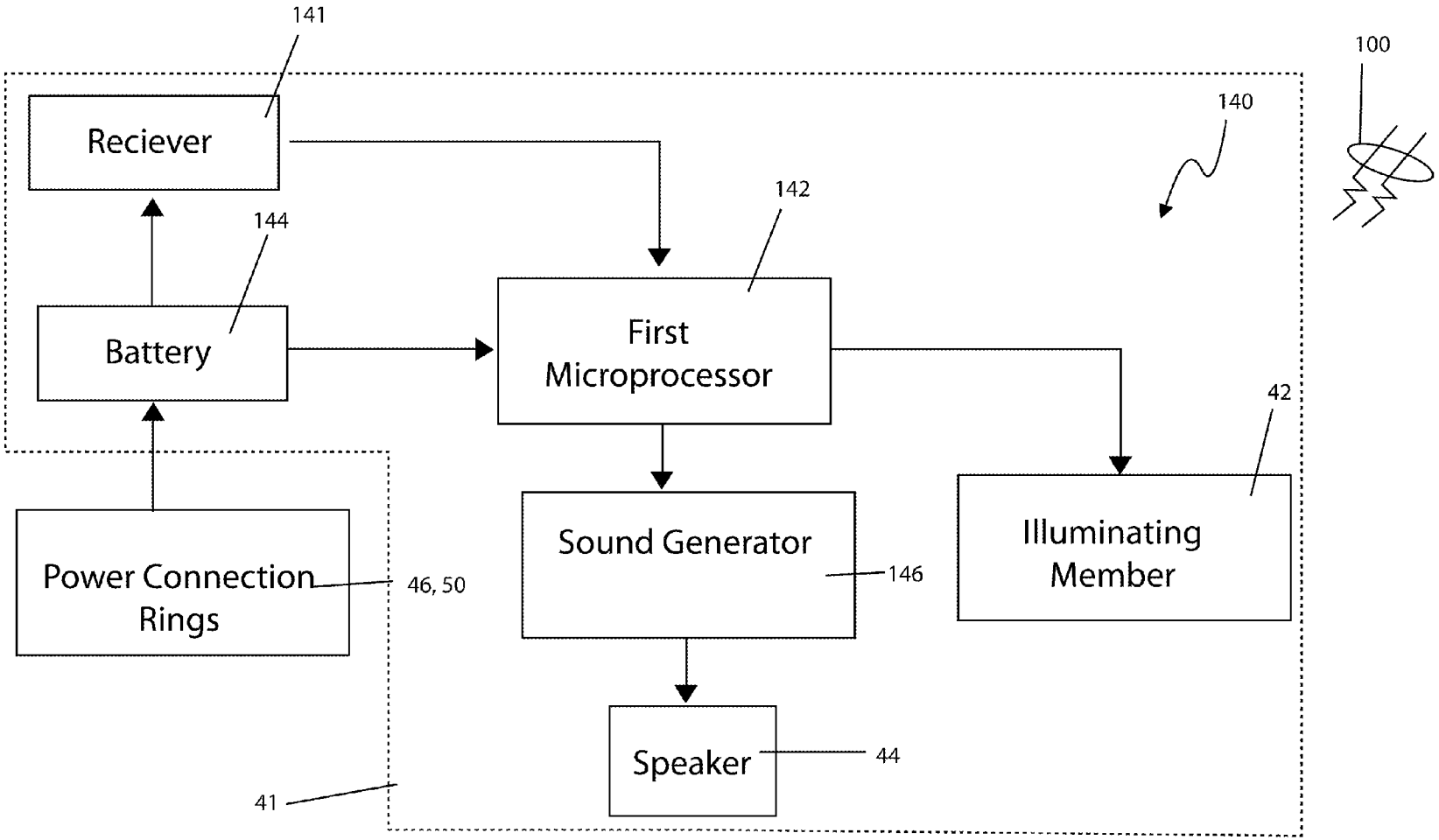
FIG. 5 is an electronic block diagram of a drinking vessel locator assembly 40, according to a preferred embodiment of the present invention; and, FIG. 6 is an electronic block diagram of a transmitter assembly 160, according to a preferred embodiment of the present invention.

Referring now to FIG. 5, an electronic block diagram of the drinking vessel locator assembly 40, according to the preferred embodiment of the present invention, is disclosed. The drinking vessel locator assembly 40 comprises the receiver 141, the first microprocessor 142, the battery 144, the speaker 44, the sound generator 146, and the illuminating member 42. The sound generator 146 is conventionally connected to the first microprocessor 142, and further includes the speaker 44 and the sound generator 146 being conventionally contained in the locator body 41. The sound generator 146 is capable of emitting an audible sound in the form of beeping noises or sounds through the speaker 44, thereby allowing a user to hear the noises and locate the drinking vessel 20 when the control button portion 162 of the transmitter/charger base 60 is pressed. In like manner, the illuminating member 42 provides a visual indicator to aid in finding the drinking vessel 20.

Figure 6:
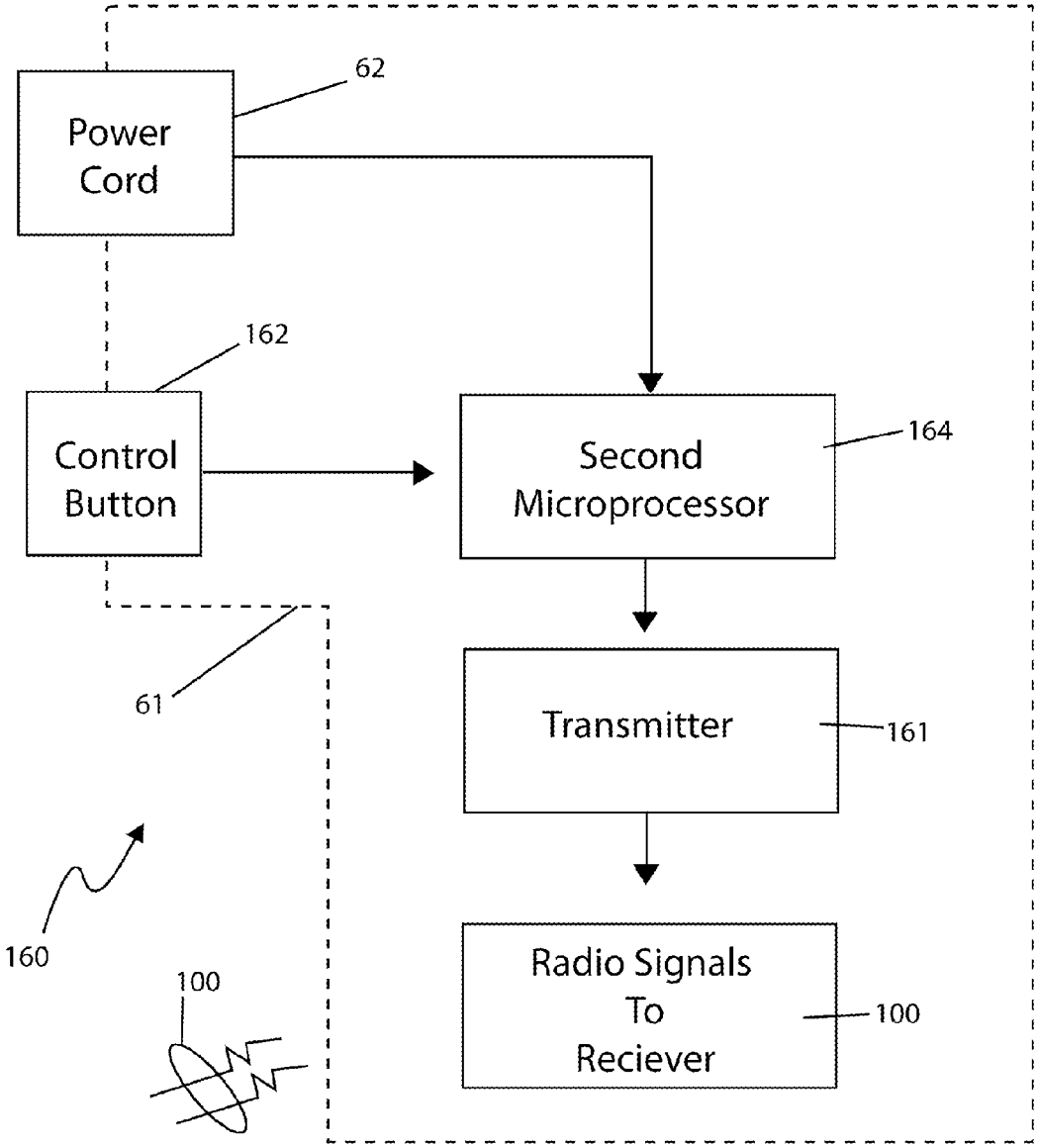

Referring now to FIG. 6, an electronic block diagram of the transmitter assembly 160, according to the preferred embodiment of the present invention, is disclosed. The transmitter assembly 160 is located therewithin the transmitter housing 61 and provides containment of the transmitter 166, the second microprocessor 164, and the control button 162. Electrical power is provided thereto said transmitter assembly 160 via connection of the power cord 62. To activate the transmitter assembly 160 a user presses the control button 162, thereby emitting an activating radio signal 100 thereto the receiver assembly 140.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: locating a convenient place to place the transmitter/charger base 60 to allow the removable drinking vessel locator assembly 40 to be placed thereupon the first 66 and second 70 base connectors to recharge the battery 144; plugging the electrical plug 64 thereinto a standard wall outlet, thereby allowing electrical power to flow through the power cord 62 and into the transmitter/charger base 60; allowing a period of time to charge said rechargeable battery 144; allowing a user to transport and drink therefrom the drinking vessel 20 with attached drinking vessel locator assembly 40 in a normal manner; pushing the control button 162 located on the transmitter/charger base 60 to activate the transmitter assembly 160 which in turn generates and transmits a radio signal 100 thereto the drinking vessel locator assembly 40 attached thereto the drinking vessel 20 via the antenna 168; subsequently activating the sound generator 146, thereby emitting an audible sound in the form of beeping noises or sounds therefrom the speaker 44 and; allowing the illuminating member 42 to illuminate; allowing a care giver to hear the noises and see the illumination, thereby locating the misplaced drinking vessel 20; threadingly detaching the drinking vessel locator portion 40 therefrom the drinking vessel 20; washing and/or sterilizing the drinking vessel 20 as desired; and, benefiting therefrom improved sanitation of a child's drinking vessel 20 and timely location thereof said drinking vessel 20 while using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A drinking vessel locating system comprising:
a drinking vessel;
a drinking vessel locator assembly affixed to said drinking vessel and including a receiver assembly;
a transmitter/charger base including a transmitter assembly transmitting a radio signal to said receiver assembly; and
a rechargeable battery which is charged when said drinking vessel is placed on said transmitter/charger base;
wherein an audible sound is activated when said receiver assembly is activated for a predetermined time period.

2. The drinking vessel locating system of claim 1, wherein said drinking vessel locator assembly comprises:
a male first threaded region; and
a female second threaded region located along a bottom perimeter edge of said drinking vessel and being removably engaged to said male first threaded region.

3. The drinking vessel locating system of claim 1, wherein said drinking vessel locator assembly comprises: a locator body including a cup-shaped enclosure provided with a speaker and an illuminating member disposed through a wall portion thereof respectively.

4. The drinking vessel locating system of claim 1, wherein said drinking vessel locator assembly further comprises:
a circular first receiver connector;
a first insulator; and
a second receiver connector arranged in a circumscribed circular manner along a convex bottom surface of said drinking vessel locator assembly;
wherein said first and second receiver connectors are electrically isolated from each other by said first insulator.

5. The drinking vessel locating system of claim 4, wherein said transmitter/charger base comprises a first base connector and a second base connector contacting said first receiver connector and second receiver connector respectively;
wherein said first and second receiver connectors and said corresponding first and second base connectors include matching cup-shaped profiles nested within each other during battery charging procedures; and
wherein said circular shape of said first and second base connectors and said first and second receiver connectors provides a recharging current flow to said battery regardless of a rotational position of said drinking vessel when nested within said transmitter/charger base.

6. The drinking vessel locating system of claim 1, wherein said transmitter/charger base comprises a transmitter housing having a generally hemispherical shape with a flat anti-skid bottom surface to thereby providing a stable base on which to charge said drinking vessel locator assembly;
wherein said transmitter assembly is integrally molded to an inner surface of said transmitter/charger base; and
wherein said transmitter assembly includes a transmitter and a second microprocessor electrically coupled thereto.

7. The drinking vessel locating system of claim 1, wherein said transmitter/charger base further comprises:
a first base connector;
a second insulator; and a second base connector contacting said first receiver connector and second receiver connectors;

wherein said first and second base connectors are arranged in a circumscribed circular manner along a concave top surface of said transmitter/charger base; and wherein said first and second base connectors provide a matching physical profile and thereby establish an efficient electrical connection with said first and second receiver connectors.

8. The drinking vessel locating system of claim 7, wherein said first and second base connectors provide a gravity-aided contact to charge said rechargeable battery.

9. The drinking vessel locating system of claim 1, wherein said drinking vessel locator assembly comprises:

a receiver;

a first microprocessor electrically coupled thereto;

a battery electrically coupled to said receiver;

a sound generator contained in said locator body and connected to said first microprocessor; and a speaker in communication with said sound generator.

10. A drinking vessel locating system comprising:

a drinking vessel;

a drinking vessel locator assembly affixed to a base portion of said drinking vessel and including a receiver assembly;

a transmitter/charger base including a transmitter assembly transmitting a radio signal to said receiver assembly; and a rechargeable battery which is charged when said drinking vessel is placed on said transmitter/charger base;

wherein an audible sound is activated when said receiver assembly is activated for a predetermined time period.

11. The drinking vessel locating system of claim 10, wherein said drinking vessel locator assembly comprises:

a male first threaded region; and a female second threaded region located along a bottom perimeter edge of said drinking vessel and being removably engaged to said male first threaded region.

12. The drinking vessel locating system of claim 10, wherein said drinking vessel locator assembly comprises: a locator body including a cup-shaped enclosure provided with a speaker and an illuminating member disposed through a wall portion thereof respectively.

13. The drinking vessel locating system of claim 10, wherein said drinking vessel locator assembly further comprises:

a circular first receiver connector;

a first insulator; and a second receiver connector arranged in a circumscribed circular manner along a convex bottom surface of said drinking vessel locator assembly;

wherein said first and second receiver connectors are electrically isolated from each other by said first insulator.

14. The drinking vessel locating system of claim 13, wherein said transmitter/charger base comprises a first base connector and a second base connector contacting said first receiver connector and second receiver connector respectively;

wherein said first and second receiver connectors and said corresponding first and second base connectors include matching cup-shaped profiles nested within each other during battery charging procedures; and wherein said circular shape of said first and second base connectors and said first and second receiver connectors provides a recharging current flow to said battery regardless of a rotational position of said drinking vessel when nested within said transmitter/charger base.

15. The drinking vessel locating system of claim 10, wherein said transmitter/charger base comprises a transmitter housing having a generally hemispherical shape with a flat anti-skid bottom surface to thereby providing a stable base on which to charge said drinking vessel locator assembly;

wherein said transmitter assembly is integrally molded to an inner surface of said transmitter/charger base; and wherein said transmitter assembly includes a transmitter and a second microprocessor electrically coupled thereto.

16. The drinking vessel locating system of claim 10, wherein said transmitter/charger base further comprises:

a first base connector;

a second insulator; and a second base connector contacting said first receiver connector and second receiver connectors;

wherein said first and second base connectors are arranged in a circumscribed circular manner along a concave top surface of said transmitter/charger base; and wherein said first and second base connectors provide a matching physical profile and thereby establish an efficient electrical connection with said first and second receiver connectors.

17. The drinking vessel locating system of claim 16, wherein said first and second base connectors provide a gravity-aided contact to charge said rechargeable battery.

18. The drinking vessel locating system of claim 10, wherein said drinking vessel locator assembly comprises:

a receiver;

a first microprocessor electrically coupled thereto;

a battery electrically coupled to said receiver;

a sound generator contained in said locator body and connected to said first microprocessor; and a speaker in communication with said sound generator.

19. A method of utilizing a drinking vessel locating system, said method comprising the following steps:

providing a drinking vessel;

providing a drinking vessel locator assembly affixed to a base portion of said drinking vessel wherein said drinking vessel includes a receiver assembly;

providing a transmitter/charger base including a transmitter assembly that transmits a radio signal to said receiver assembly;

providing and charging a rechargeable battery by placing said drinking vessel on said transmitter/charger base; and activating an audible sound when said receiver assembly is activated for a predetermined time period.

* * * * *